US007805225B2

(12) United States Patent
Okuyama et al.

(10) Patent No.: US 7,805,225 B2
(45) Date of Patent: Sep. 28, 2010

(54) REMOTE CONTROL APPARATUS FOR A BOAT

(75) Inventors: Takashi Okuyama, Hamamatsu (JP); Noriyoshi Ichikawa, Hamamatsu (JP); Makoto Ito, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 845 days.

(21) Appl. No.: 11/731,681

(22) Filed: Mar. 30, 2007

(65) Prior Publication Data

US 2007/0250222 A1 Oct. 25, 2007

(30) Foreign Application Priority Data

Apr. 21, 2006 (JP) ..... 2006-118039

(51) Int. Cl.
*F02D 45/00* (2006.01)
*G06F 19/00* (2006.01)

(52) U.S. Cl. ..... 701/2; 701/21; 701/36; 440/84; 114/114 R

(58) Field of Classification Search ..... 701/2, 701/1, 36, 115, 21; 440/84, 53, 75; 114/114 R; 370/400, 458
See application file for complete search history.

(56) References Cited

U.S. PATENT DOCUMENTS 1,843,272 A 2/1932 Evinrude
2,204,265 A 6/1940 Wentzel
2,466,282 A 4/1949 Sparrow et al.
2,740,260 A 4/1956 Blanchard
3,986,363 A 10/1976 Beamon et al.
4,412,422 A 11/1983 Rossi
4,622,938 A 11/1986 Wenstadt et al.
4,646,696 A 3/1987 Dogadko
4,648,497 A 3/1987 Kawazoe
4,747,381 A 5/1988 Baltz et al.

(Continued)

FOREIGN PATENT DOCUMENTS

JP 03-061196 3/1991

(Continued)

OTHER PUBLICATIONS

Product Manual for i6000TEC—Triple Engine Electronic Shift & Throttle of Teleflex Marine Co., Ltd., Jul. 2000.

(Continued)

*Primary Examiner*—Tan Q Nguyen
(74) *Attorney, Agent, or Firm*—Keating & Bennett, LLP

(57) ABSTRACT

A remote control apparatus for controlling multiple propulsion units of a boat is provided. The remote control apparatus, in one embodiment, comprises a body having a first control lever and a second control lever. An electronic control unit is disposed within the body of the remote control apparatus and comprises a storage device and a contact member. The storage device can store a correction value for calibrating the control levers, while the contact member determines when correction values can be entered into the storage device when the contact member is in an enabled state. The remote control apparatus can be calibrated before the apparatus is installed on the boat, thereby eliminating the need for an operator to calibrate the remote control apparatus. A boat having the remote control apparatus described herein and a method for storing a calibration value for the control lever are also provided.

21 Claims, 5 Drawing Sheets

U.S. PATENT DOCUMENTS

| | | | | |
|---|---|---|---|---|
| 4,755,156 | A | 7/1988 | Wagner | |
| 4,788,955 | A | 12/1988 | Wood | |
| 4,801,282 | A | 1/1989 | Ogawa | |
| 4,805,396 | A | 2/1989 | Veerhusen et al. | |
| 4,809,506 | A | 3/1989 | Lauritsen | |
| 4,810,216 | A | 3/1989 | Kawamura | |
| 4,836,809 | A | 6/1989 | Pelligrino | |
| 4,850,906 | A | 7/1989 | Kanno et al. | |
| 4,858,585 | A | 8/1989 | Remmers | |
| 4,898,045 | A | 2/1990 | Baba | |
| 4,964,276 | A | 10/1990 | Sturdy | |
| 5,004,962 | A | 4/1991 | Tonss et al. | |
| 5,051,102 | A | 9/1991 | Onoue | |
| 5,062,403 | A | 11/1991 | Breckenfeld et al. | |
| 5,062,516 | A | 11/1991 | Prince | |
| 5,065,723 | A | 11/1991 | Broughton et al. | |
| 5,103,946 | A | 4/1992 | Masters et al. | |
| 5,157,956 | A | 10/1992 | Isaii et al. | |
| 5,167,212 | A | 12/1992 | Peter et al. | |
| 5,273,016 | A | 12/1993 | Gillespie et al. | |
| 5,318,466 | A | 6/1994 | Nagafusa | |
| 5,381,769 | A | 1/1995 | Nishigaki et al. | |
| 5,492,493 | A | 2/1996 | Ohkita | |
| 5,539,294 | A | 7/1996 | Kobayashi | |
| 5,595,159 | A | 1/1997 | Huber et al. | |
| 5,664,542 | A | 9/1997 | Kanazawa et al. | |
| 5,730,105 | A | 3/1998 | McGinnity | |
| 5,749,343 | A | 5/1998 | Nichols et al. | |
| 5,771,860 | A | 6/1998 | Bernardi | |
| 5,782,659 | A | 7/1998 | Motose | |
| 5,899,191 | A | 5/1999 | Rabbit et al. | |
| 6,015,319 | A | 1/2000 | Tanaka | |
| 6,026,783 | A | 2/2000 | Nestvall et al. | |
| 6,058,349 | A | 5/2000 | Kikori et al. | |
| 6,073,509 | A | 6/2000 | Salecker et al. | |
| 6,073,592 | A | 6/2000 | Brown et al. | |
| 6,095,488 | A | 8/2000 | Semeyn, Jr. et al. | |
| 6,098,591 | A | 8/2000 | Iwata | |
| 6,109,986 | A | 8/2000 | Gaynor et al. | |
| 6,233,943 | B1 | 5/2001 | Beacom et al. | |
| 6,273,771 | B1 | 8/2001 | Buckley et al. | |
| 6,280,269 | B1 | 8/2001 | Gaynor | |
| 6,351,704 | B1 * | 2/2002 | Koerner | 701/115 |
| 6,379,114 | B1 | 4/2002 | Schott et al. | |
| 6,382,122 | B1 | 5/2002 | Gaynor et al. | |
| 6,414,607 | B1 | 7/2002 | Gonring et al. | |
| 6,587,765 | B1 | 7/2003 | Graham et al. | |
| 6,612,882 | B2 | 9/2003 | Shidara et al. | |
| 6,704,643 | B1 * | 3/2004 | Suhre et al. | 701/115 |
| 6,751,533 | B2 | 6/2004 | Graham et al. | |
| 6,910,927 | B2 | 6/2005 | Kanno | |
| 6,965,817 | B2 | 11/2005 | Graham et al. | |
| 7,121,908 | B2 | 10/2006 | Okuyama | |
| 7,142,955 | B1 | 11/2006 | Kern et al. | |
| 7,153,174 | B2 | 12/2006 | Takada et al. | |
| 7,220,153 | B2 | 5/2007 | Okuyama | |
| 7,330,782 | B2 * | 2/2008 | Graham et al. | 701/21 |
| 2003/0082962 | A1 | 5/2003 | Kanno | |
| 2003/0092331 | A1 | 5/2003 | Okuyama | |
| 2003/0093196 | A1 | 5/2003 | Okuyama | |
| 2004/0029461 | A1 | 2/2004 | Shomura | |
| 2005/0118895 | A1 | 6/2005 | Kanno et al. | |
| 2005/0245145 | A1 | 11/2005 | Takada et al. | |
| 2005/0286539 | A1 | 12/2005 | Okuyama | |
| 2006/0240720 | A1 | 10/2006 | Yamashita | |
| 2007/0082565 | A1 | 4/2007 | Okuyama | |
| 2007/0082566 | A1 | 4/2007 | Okuyama | |
| 2007/0178780 | A1 | 8/2007 | Ito et al. | |
| 2007/0218785 | A1 | 9/2007 | Okuyama | |
| 2007/0232162 | A1 | 10/2007 | Okuyama et al. | |
| 2007/0293102 | A1 | 12/2007 | Okuyama et al. | |

FOREIGN PATENT DOCUMENTS

| | | |
|---|---|---|
| JP | 2001-260986 | 9/2001 |
| JP | 2003-098044 | 4/2003 |
| JP | 2003-127986 | 5/2003 |
| JP | 2003-146293 | 5/2003 |
| JP | 2004-068704 | 3/2004 |
| JP | 2004-244003 | 9/2004 |
| JP | 2005-297785 | 10/2005 |
| WO | WO 2005-102833 | 11/2005 |

OTHER PUBLICATIONS

Barron, Jim, "Get on the Bus," Trailer Boats Magazine, Jun. 2000, p. 36.

Spisak, Larry, "Know It by Chart," Boating Magazine, May 2000, p. 100.

Denn, James, "Gains in technology will alter makeup of the . . . ," Boating Industry International, Nov. 2000, pp. 41-47.

Declaration of Daniel J. Carr, submitted in U.S. Appl. No. 09/874,545, dated May 15, 2002.

Denn, James, "Future boats sales will hinge on technology," Boating Industry International, Nov. 2000, p. 40.

Hemmel, Jeff, "Information, Please—The digital boating revolution begins," Boating Magazine, Sep. 2000.

Kelly, Chris, "Can We Talk?" Power & Motoryacht Magazine, Jun. 2000, pp. 36, 38 and 39.

"Plug and Play", Advertisement from "Motorboating," Dec. 2000, p. 57.

Instruction Manual for "MagicBus™ 13000 Series Intelligent Steering," Teleflex, Inc.

* cited by examiner

REMOTE CONTROL APPARATUS FOR A BOAT

CROSS-REFERENCE TO RELATED APPLICATIONS

This application is based on and claims priority under 35 U.S.C. §119(a)-(d) to Japanese Patent Application No. 2006-118039, filed Apr. 21, 2006, the entire contents of which is hereby incorporated by reference.

BACKGROUND OF THE INVENTION

1. Field of the Invention

The present invention relates to a remote control apparatus for a boat and, in particular, to a remote control apparatus that minimizes variations among propulsion units of a boat.

2. Description of the Related Art

A remote control apparatus allows an operator to control the operation of the propulsion units of a boat. A throttle opening of a propulsion unit is typically controlled by setting a corresponding control lever at a particular position. The throttle opening of each propulsion unit in a multi-propulsion unit boat may be different because detection sensors for detecting the positions of associated control levers may have variations in performance. Consequently, the rotational speeds of the output shafts of the respective propulsion units will often be different. As a result, an operator of a boat having a plurality of propulsion units may not be able to operate the boat in a manner in which the operator intends.

To reduce or eliminate variations in the rotational speeds of the output shafts of the propulsion units due to variations in control lever position readings, conventional remote control apparatuses are usually adapted for calibration.

Calibration involves setting correction values optimum for the individual circuits of the respective propulsion units based on the actual positions of the associated control levers and the positions detected by corresponding sensors. The correction values that are optimum for the individual circuits of the respective propulsion units are commonly written into storage devices of associated electronic control units, which typically are provided outside of the remote control apparatus. The electronic control units control the propulsion units based on the correction values so that, ideally, the same desired operation of respective propulsion units will provide the same rotational speed of the output shafts of the respective propulsion units.

There are some problems, however, that are presented by the calibration process. Conventional calibration systems typically involve many complicated steps and can be difficult to execute properly. Meanwhile, calibration is often performed by end-user customers who purchased boats after the boats have been delivered by a manufacturer. The calibration process can be burdensome for such end-user customers who may lack the sophistication necessary to properly calibrate the propulsion units.

Monitor-display calibration systems can be problematic as well. Some remote control apparatuses are designed to make calibration easier so that end-user customers can perform calibration by following an operation guide screen displayed on a monitor. In such apparatuses, an operator can switch from a normal operational mode to an inspection mode that allows the operator to calibrate the propulsion units of a boat. In these systems, however, the operator might inadvertently switch to the inspection mode while operating the boat, which could have an undesirable effect on the operation of the boat.

SUMMARY OF THE INVENTION

In one aspect, a remote control apparatus for a boat having more than one propulsion unit is provided. The remote control apparatus comprises a body having a first side, a second side, and an upper face. The remote control apparatus also comprises a first control lever having a first lever position sensor disposed on the first side of the body and a second control lever having a second lever position sensor disposed on the second side of the body. An electronic control unit is disposed at least in part within the body of the remote control apparatus. The electronic control unit comprises a storage device and a contact member. The storage device is configured to store a correction value for calibrating the control levers and the lever position sensors of the remote control apparatus. The contact member is configured to permit correction values to be entered into the storage device when the contact member is in an enabled state. In one embodiment of the remote control apparatus, the electronic control unit can detect a state of the contact member to determine whether the contact member is in the enabled state for calibrating the control levers and lever position sensors.

In an additional aspect, a boat having more than one propulsion unit is provided. The boat comprises a hull and more than one outboard motor is connected to the hull. A seat is configured to accommodate at least one operator of the boat. The boat also comprises a remote control system for controlling the outputs from the more than one propulsion unit. A remote control apparatus is in communication with the remote control system. The remote control apparatus comprises a body having a first side, a second side, and an upper face. A first control lever having a first lever position sensor is disposed on the first side of the body and a second control lever having a second lever position sensor is disposed on the second side of the body. An electronic control unit is disposed at least in part within the body of the remote control apparatus. The electronic control unit comprises a storage device and a contact member. The storage device is configured to store a correction value for calibrating the control levers and the lever position sensors of the remote control apparatus. The contact member is configured to permit correction values to be entered into the storage device when the contact member is in an enabled state. In one embodiment of the boat, the electronic control unit can detect a state of the contact member to determine whether the contact member is in the enabled state for calibrating the control levers and lever position sensors.

In another aspect, a method for storing a calibration value for a control lever in a remote control apparatus of a boat is provided. In this method, a remote control apparatus is provided. The remote control apparatus has a control lever, a storage device, and a contact member. The contact member is mechanically engaged. The control lever is positioned in a first position. An actuator is activated. A signal is delivered to the storage device in response to activating the actuator. The signal corresponds to the first position of the control lever. A value is stored in the storage device based on the signal delivered to the storage device.

BRIEF DESCRIPTION OF THE DRAWINGS

These and other features, aspects, and advantages of the present remote control apparatus for a boat will now be described in connection with preferred embodiments of the remote control apparatus as shown in the accompanying drawings. The illustrated embodiments, however, are merely examples and are not intended to limit the remote control apparatus to the specific embodiments described herein. The drawings include five figures.

DETAILED DESCRIPTION OF PREFERRED EMBODIMENTS

The embodiments of the present remote control apparatus will be described hereinafter in detail with reference to the accompanying drawings. The structure of the remote control apparatus will be described first with reference to FIGS. 1 through 3. It should be noted that the remote control apparatus described herein can be used with a variety of marine vehicles, such as, but not limited to, boats having a hull with more than one propulsion unit connected to the hull. In a preferred embodiment, the propulsion units include outboard motors. However, other types of propulsion units, such as stem drives, impellers, and the like are contemplated.

Figure 1:
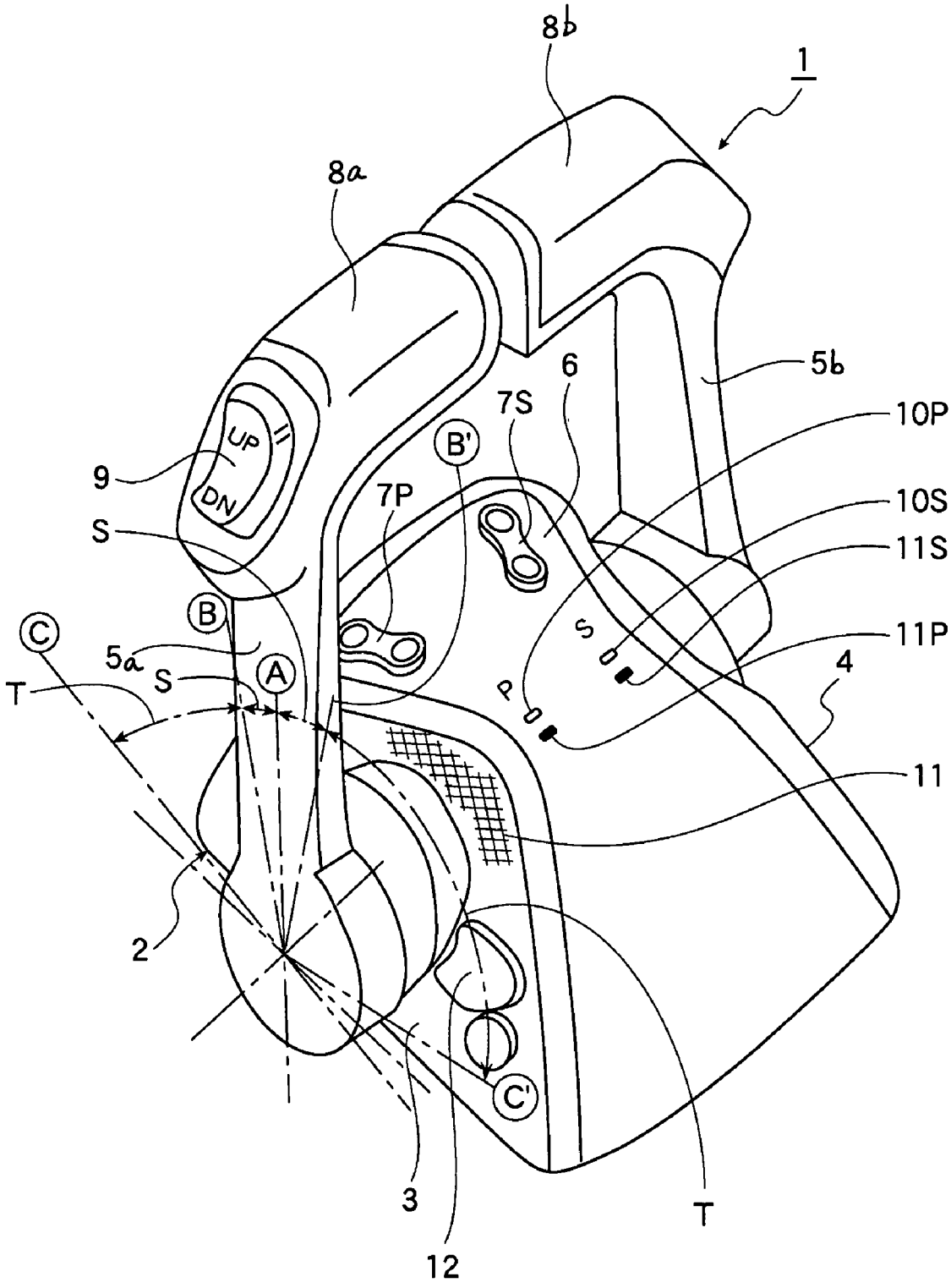
FIG. 1 is a perspective view of a remote control apparatus according to an embodiment of the present remote control apparatus for a boat.

As shown in FIG. 1, a remote control apparatus 1, in one embodiment, has a box-shaped body 2 designed for installation in a location on a boat. The remote control apparatus 1 can be installed, for example, on a table in front of a console facing an operator's seat or on a deck proximate to the operator's seat. As illustrated in FIG. 1, the body 2 has a generally truncated pyramid shape, with its edges, or corners, rounded so as not to inflict injury to an operator's hand or the like.

In one embodiment, the body 2 has a left side face 3 and a right side face 4, each of which has a control lever 5 provided thereon. As shown in FIG. 1, a first control lever 5*a* is disposed on the left side face 3, and a second control lever 5*b* is disposed on the right side face 4. The first and second control levers 5*a*, 5*b* can pivot forward and rearward to be used for shift and throttle operations for a plurality of propulsion units. When the control lever 5 is held within a shift range S, which is defined by a range of angular positions between B and B' (including a neutral position A), only a shift operation is effected, with an associated throttle valve held fully closed (such as an idle state). On the other hand, when the control lever 5 is held outside of the shift range S (such as within a throttle range T defined by a range of angular positions between B and C and between B' and C'), the associated throttle valve can be operated between a fully closed position and a fully open position, with a shift position maintained.

The apparatus of the illustrated embodiment is adapted for shift and throttle operations to two propulsion units mounted on a boat, using a pair of left and right control levers 5*a*, 5*b*. The apparatus also has tilt and trim angle adjustment switches 7P, 7S located on a upper face 6 of the body 2 and associated with the respective propulsion units. The tilt and trim angle adjustment switches 7P, 7S are at positions where the switches are operable by an operator's fingers as the operator's hand is placed on the upper face 6 with the fingers pointing forward. It should be noted that, in one embodiment, no other switches are located at a portion of the apparatus that is to contact an operator's palm.

At upper ends of the first and second control levers 5*a*, 5*b*, horizontal handles 8*a*, 8*b* preferably are provided. Each horizontal handle 8*a*, 8*b* has a main tilt and trim angle adjustment switch 9 provided on its side face to allow the operator to adjust tilt and trim angles for two propulsion units at the same time.

As described above, the remote control apparatus 1 of the illustrated embodiment is for use on a boat with two propulsion units. It should be noted, however, that when a boat has three or more propulsion units, three or more tilt and trim angle adjustment switches may be provided on the upper face 6 of the body 2 correspondingly to the number of the propulsion units. In addition, three or more control levers may be provided in a boat having three or more propulsion units.

In one embodiment of the present remote control apparatus, operation indication lights 10P, 10S and warning indication lights 11P, 11S are located behind the portion of the upper face 6 of the body 2 that an operator typically contacts with his or her palm. The operation indication lights 10P, 10S are designed to indicate normal operations of associated left and right propulsion units, respectively. The warning indication lights 11P, 11S are designed to indicate abnormal operations of the associated left and right propulsion units, respectively.

In another embodiment, on either the left side face 3 or the right side face 4 of the body 2 of the remote control apparatus 1, an idling switch 12 is provided to allow the operator to select between an idling mode and a normal mode. The idling switch 12 uses an open/close electric circuit to switch between the idling mode and the normal mode. When the switch is set to the idling mode, the idling mode continues until the operator moves the associated control lever 5*a*, 5*b*. Advantageously, unlike a conventional mechanical idling button, the operator need not press and hold the button to maintain the idling mode.

Figure 2:
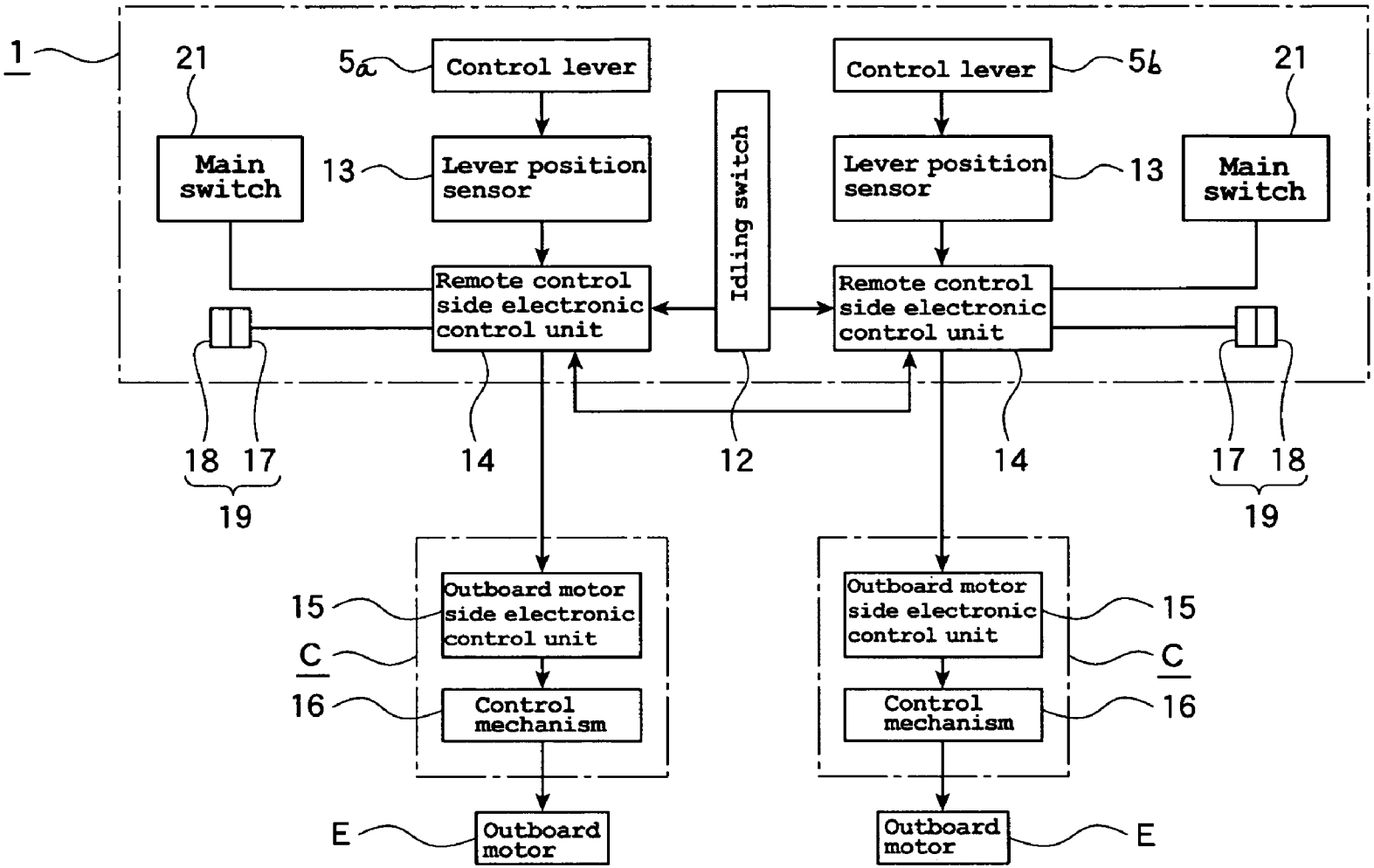
FIG. 2 is a block diagram of the remote control apparatus as shown in FIG. 1.
Figure 3:
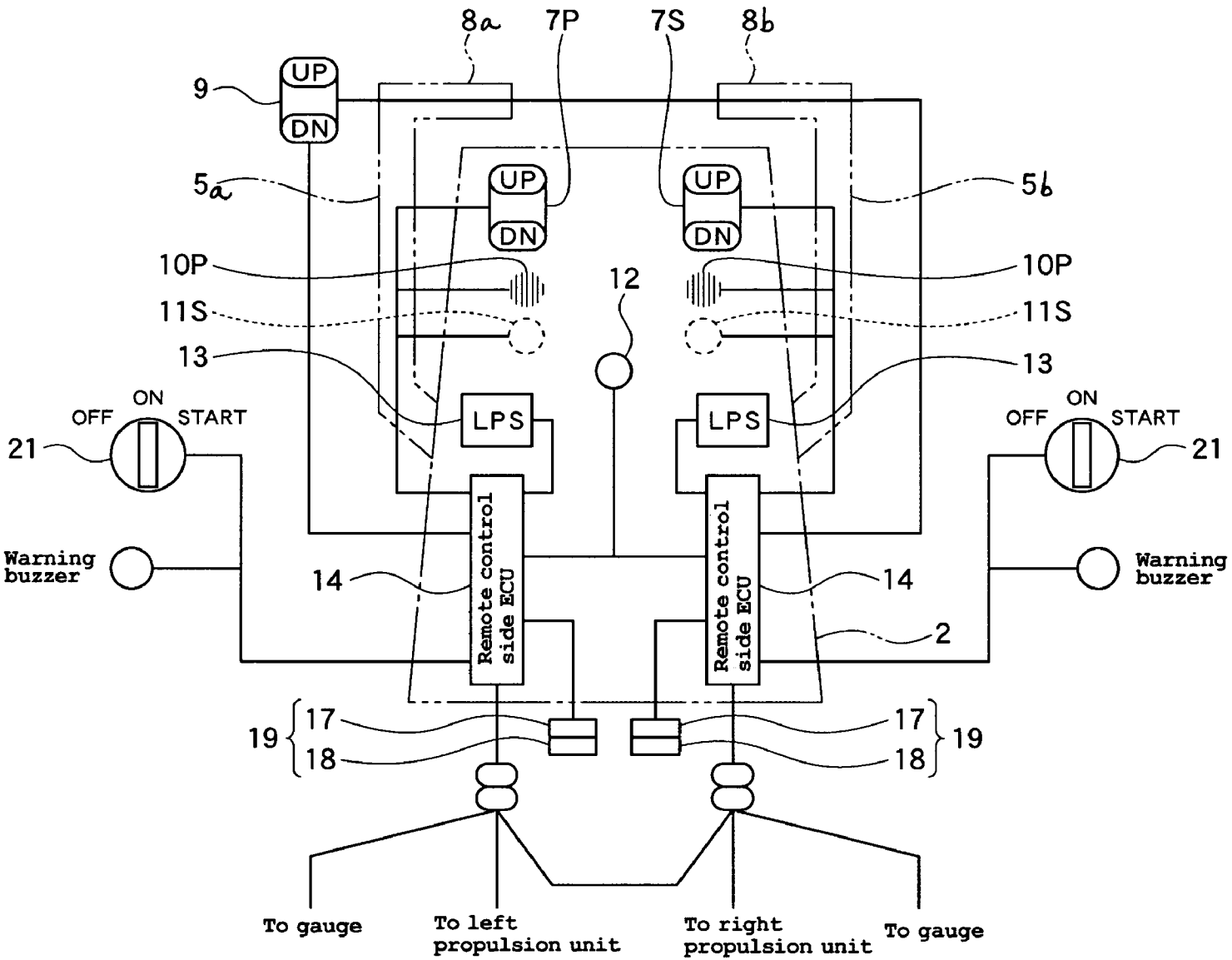
FIG. 3 is a schematic circuit diagram of the remote control apparatus as shown in FIG. 1.

With reference primarily to FIGS. 2 and 3, a lever position sensor (LPS) 13 is disposed in the body 2 of the remote control apparatus. The lever position sensor 13 preferably can detect the position of the associated control lever 5. The lever position sensor 13 detects the position of the control lever 5. A signal indicating the detection value is then transmitted to an outboard motor side electronic control unit 15 of a controller C provided in an outboard motor E. The signal is transmitted via a remote control side electronic control unit 14 provided in the body 2 of the remote control apparatus 1. The outboard motor side electronic control unit 15 is connected to a control mechanism 16 to implement shift and throttle operations and tilt and trim angle adjustments to the outboard motor E.

In one embodiment, the remote control side electronic control unit 14 in the body 2 of the remote control apparatus 1 has a storage device (which is not shown in the drawings) to store proper correction values used to achieve reference values in calibration of the control lever 5 and the lever position sensor 13 based on the actual relationship between predetermined positions of the control lever 5 and corresponding detection values from the lever position sensor 13.

In another embodiment, a contact member 19 dedicated for an inspection mode is disposed in the remote control side electronic control unit 14. The contact member 19 is a connector assembly including a first connector 17 that can be either a male connector or a female connector. The contact member 19 also has a second connector 18 that can also be either a female connector or a male connector. If the first connector 17 is a male connector, then the second connector 18 preferably is a female connector (and vice versa).

In one embodiment, the second connector 18 is connectable to the first connector 17 such that the first connector 17 can mechanically engage the second connector 18. For example, in one embodiment, the first connector 17 preferably interlocks with the second connector 18. The contact member 19 is used to write into the storage device of the remote control side electronic control unit 14 correction values to correct variations in performance of the lever position sensors 13, which are to detect the positions of the associated control levers 5 for throttle operation and to detect variations in mechanical performance of the control levers 5.

At the location where the boat is manufactured, the second connector 18 is typically connected to a jumper wire and the contact member 19 has a closed circuit. This means that the apparatus is in the inspection mode, such that writing correction values into the storage device of the remote control side electronic control unit 14 is enabled. On the other hand, after the correction value write-in process (e.g., calibration) at the factory or site of manufacture, the second connector 18 is disconnected from the first connector 17 so that the contact member 19 has an open circuit. As such, the apparatus is in a normal mode in which writing correction values into the storage device of the remote control side electronic control unit 14 is disabled. It should be noted that after the second connector 18 is disconnected from the first connector 17, a sealing cap (which is not shown in the drawings) may be fitted onto the first connector 17.

When the pre-calibrated remote control apparatus 1 is installed on a boat, the first connector 17 with the fitted sealing cap will often be disposed under the table in front of the console or under the deck proximate to the operator's seat. Thus, in one embodiment, an operator of a boat will not be able to use the contact member 19 during operation of the boat.

As discussed above, the remote control apparatus 1 in one embodiment has the remote control side electronic control unit 14 included in its body 2 and has the storage device to store correction values to correct variations in performance of the lever position sensors 13 and variations in mechanical performance of the control levers 5. Advantageously, it is thus possible to calibrate to the remote control apparatus 1 at a manufacturer's factory before subsequent installation on a boat, thereby eliminating the need for end-user customers to perform such calibration that might be difficult or otherwise troublesome for such customers.

Furthermore, the above arrangement effectively prevents users from mistakenly switching to the inspection mode. This is because after installation of the remote control apparatus 1 on a boat, several steps would have to be performed to adjust the correction values. First, the user would take out the first connector 17 of the contact member 19 from under the table in front of the console or under the deck proximate to the operator's seat. Second, the sealing cap 20 would be removed from the first connector 17. Third, the first connector 17 would be connected to the second connector 18, which is connected to the jumper wire. This process essentially eliminates the possibility that the user will accidentally switch to the inspection mode to change the proper correction values.

Moreover, to prevent a boat user from accidentally changing the proper correction values during calibration, the apparatus may be configured such that the inspection mode is only enabled when certain alternative or additional steps are followed. These alternative or additional steps may include connecting the first connector 17 and the second connector 18 together and turning a main switch 21 (as illustrated in FIGS. 2 and 3) of the remote control apparatus 1 to an "on" position. In addition, for the purpose of enhanced reliability, the inspection mode may be dependent upon a further step such as turning the idling switch 12 to an "on" position. It should be noted that, in one embodiment, two main switches 21 are provided such that a circuit connected to the left propulsion unit has a main switch 21 and a circuit connected to the right propulsion unit also has a main switch 21.

The remote control apparatus 1 also preferably has an indication light that is enabled in the inspection mode (or learning mode). The indication light indicates the types of learning mode, which corresponds to the positions of the associated control lever 5. In one embodiment, the types of learning mode are to be indicated by flashes of the indication light. The indication light can comprise additional lights that are provided on the body 2 of the remote control apparatus 1. Alternatively, the operation indication lights 10P, 10S, which are to indicate normal operations of the left propulsion unit and the right propulsion unit, can be used as the indication light for the inspection mode of the remote control apparatus 1.

In one embodiment of the present remote control apparatus, switching between the types of learning mode corresponding to the positions of the control lever 5 in the inspection mode can be done with a press of the idling switch 12.

Figure 4:
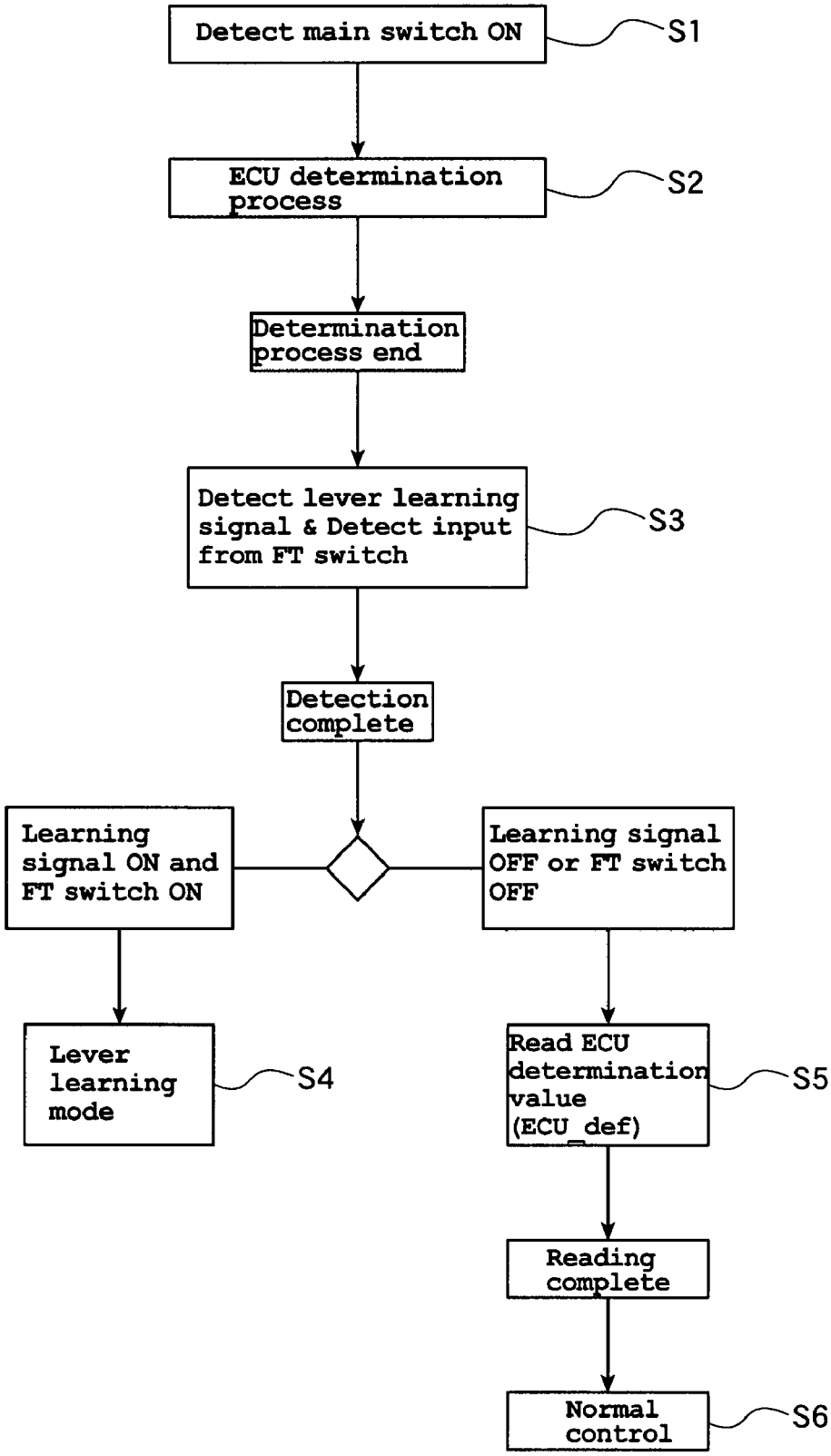
FIG. 4 is a flowchart illustrating a procedure for enabling an inspection mode when calibration of propulsion units of a boat is performed by the remote control apparatus as shown in FIG. 1.
Figure 5:
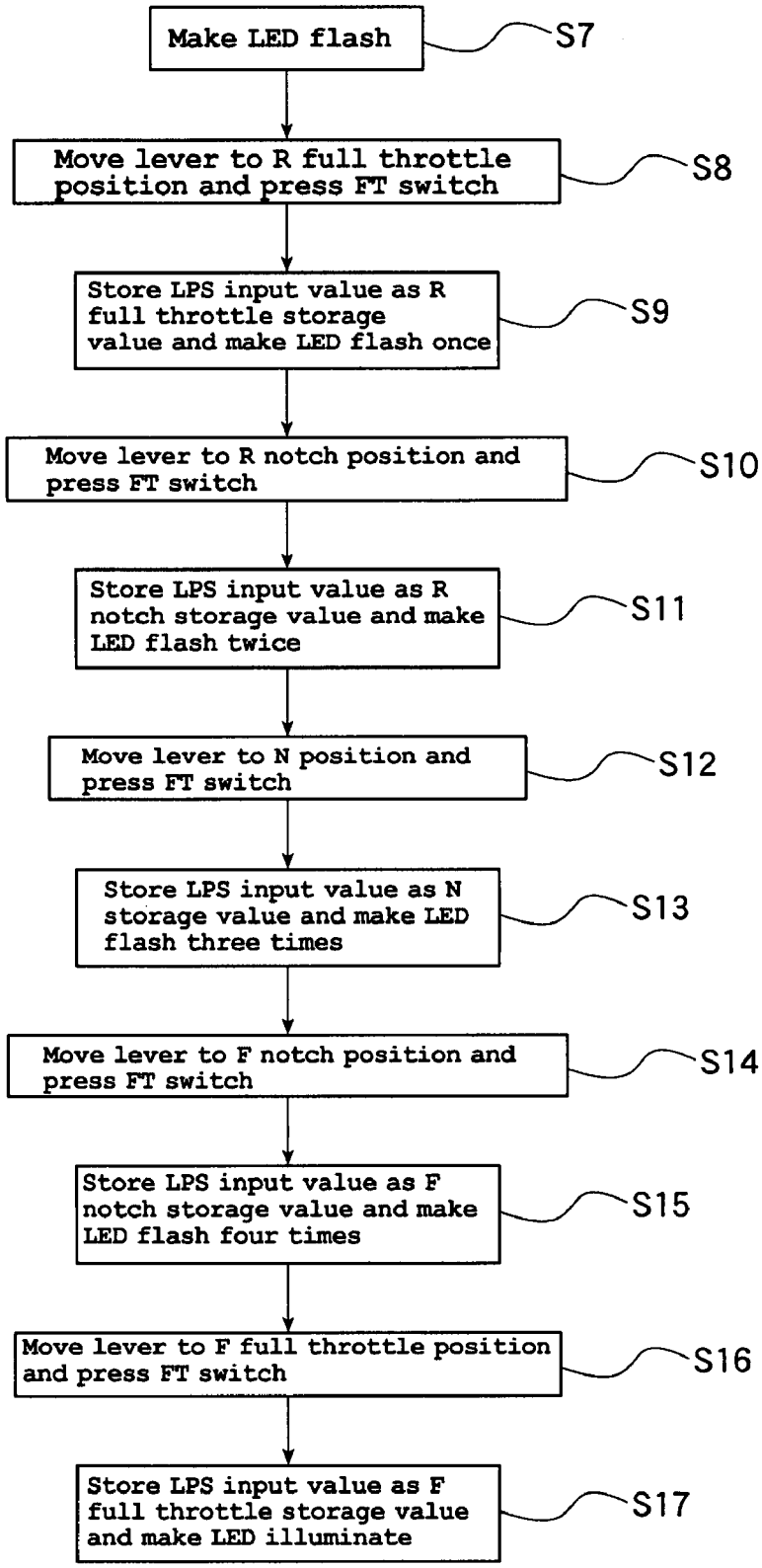
FIG. 5 is a flowchart illustrating a procedure for switching between inspection modes corresponding to positions of a control lever of the remote control apparatus as shown in FIG. 1.

Turning now to FIGS. 4 and 5, the operation of an embodiment of a remote control apparatus will be described. In one embodiment, the following procedure will be executed twice because calibration is to be performed to each circuit of the left propulsion unit (or the left outboard motor) and the right propulsion unit (or the right outboard motor). It should be noted, however, that the description of the use of a remote control apparatus which follows will not be repeated for both the left and the right propulsion units.

With reference to FIG. 4, when the main switch 21 is turned "on", the remote control side electronic control unit 14 detects the "on" state of the main switch 21 (step S1) and then executes a determination process on the remote control side electronic control unit 14 (step S2). After the determination process, the electronic control unit detects a lever learning signal and detects an "on" state of the idling switch 12 (step S3). The idling switch 12 is denoted as "FT switch" in FIGS. 4 and 5.

After detecting the lever learning signal and the "on" state of the idling switch 12, the electronic control unit 14 then determines whether the lever learning signal is "on" and the idling switch 12 is "on" or whether either the lever learning signal or the idling switch 12 is "off". On the one hand, if the lever learning signal is "on" and the idling switch 12 is "on", the lever learning mode (or inspection mode) is enabled (step S4). On the other hand, if either the lever learning signal or the idling switch 12 is "off", then the outboard motor side electronic control unit 15 reads a determination value from the remote control side electronic control unit 14 (step S5). When the reading is complete, the outboard motor side electronic control unit 15 executes a normal operation control in the normal mode (step S6).

As illustrated in FIG. 5, when the lever learning mode (or inspection mode) is enabled, the operation indication light 10P, 10S flashes (step S7) to indicate the lever learning mode.

In the lever learning mode (or inspection mode), the operator moves the control lever 5 to a reverse maximum position C' (as shown in FIG. 1) and presses the idling switch 12 once (step S8). Then, the electronic control unit stores an input voltage detection value from the lever position sensor 13 as a reverse full throttle storage value (or correction value) and makes the operation indication light 10P, 10S flash once (step S9).

Then, when the operator moves the control lever 50 to a reverse minimum position B' (as shown in FIG. 1) and presses the idling switch 12 once (step S10), the electronic control unit stores an input voltage detection value from the lever position sensor 13 as a reverse minimum position storage value (or correction value) and makes the operation indication light 10P, 10S flash twice (step S11).

In the next step, the operator moves the control lever 50 to a neutral position A (as shown in FIG. 1) and presses the idling switch 12 once (step S12). The electronic control unit then stores an input voltage detection value from the lever position sensor 13 as a neutral storage value (or correction value) and makes the operation indication light 10P, 10S flash three times (step S13).

Next, when the operator moves the control lever 50 to a forward minimum position B (as shown in FIG. 1) and presses the idling switch 12 once (step S14), the electronic control unit stores an input voltage detection value from the lever position sensor 13 as a forward minimum position storage value (or correction value) and makes the operation indication light 10P, 10S flash four times (step S15).

The operator then moves the control lever 5 to a forward maximum position C (as shown in FIG. 1) and presses the idling switch 12 once (step S16). As a result, the electronic control unit stores an input voltage detection value from the lever position sensor 13 as a forward full throttle storage value (or correction value) and makes the operation indication light 10P, 10S illuminate (step S17). This indicates that the inspection mode is terminated and the apparatus is returned to the normal mode.

As described above, the types of lever learning mode are to be indicated by the flashes of the indication light (that is, operation indication light 10P, 10S or any additional lights provided on the body 2 of the remote control apparatus 1). Advantageously, it is thus possible for the operator to identify the current type of lever learning mode according to the flashes of the indication light. Advantageously, this eliminates the need for the additional requirement of a means for displaying different operation guide screens for the respective types of lever learning mode, thereby effecting a cost reduction in the remote control apparatus 1.

The remote control apparatus 1 according to the embodiments disclosed herein has the structure and operation as described above. It is thus possible to perform calibration to the remote control apparatus 1 before subsequent installation on a boat to correct variations in performance of the detection sensors for detecting the positions of the respective control levers 5 for throttle operation and variations in mechanical performance of the control levers 5. As a result, end-user customers need not perform such calibration, which might be difficult or otherwise troublesome for such customers. Moreover, with the remote control apparatus 1 installed on a boat, the operator cannot easily operate the contact member 19. Advantageously, this configuration eliminates the possibility that the customer will accidentally switch to the inspection mode to change the proper correction values while operating the boat. Further, it is to be understood that buttons or actuators other than the idling switch 12 may be used for prompting storage of sensor readings.

Although this remote control apparatus has been disclosed in the context of certain preferred embodiments and examples, it will be understood by those skilled in the art that the present remote control apparatus extends beyond the specifically disclosed embodiments to other alternative embodiments and/or uses of the remote control apparatus and obvious modifications and equivalents thereof. In addition, while a number of variations of the remote control apparatus have been shown and described in detail, other modifications, which are within the scope of this remote control apparatus, will be readily apparent to those of skill in the art based upon this disclosure. It is also contemplated that various combinations or sub-combinations of the specific features and aspects of the embodiments may be made and still fall within the scope of the remote control apparatus. Accordingly, it should be understood that various features and aspects of the disclosed embodiments can be combined with or substituted for one another in order to form varying modes of the disclosed remote control apparatus. Thus, it is intended that the scope of the present remote control apparatus herein disclosed should not be limited by the particular disclosed embodiments described above, but should be determined only by a fair reading of the claims.

What is claimed is:

1. A remote control apparatus for a boat including more than one propulsion unit, the remote control apparatus comprising:

a body having a first side, a second side, and an upper surface, a first control lever including a first lever position sensor disposed on the first side of the body and a second control lever including a second lever position sensor disposed on the second side of the body, and an electronic control unit disposed at least in part within the body of the remote control apparatus, the electronic control unit including a storage device configured to store a correction value to calibrate the first and second control levers and the first and second lever position sensors of the remote control apparatus, the electronic control unit configured to permit correction values to be entered into the storage device when a lever learning mode is in an enabled state, wherein the electronic control unit is configured to detect a state of a signal to determine whether the lever learning mode is in the enabled state to calibrate the first and second control levers and the first and second lever position sensors.

2. The remote control apparatus of claim 1, wherein the remote control apparatus is in communication with a remote control system of the boat to control outputs from the more than one propulsion unit.

3. The remote control apparatus of claim 1, wherein the electronic control unit is configured to permit correction values to be entered into the storage device to correct variations in performance of the first lever position sensor and the second lever position sensor arranged to detect positions of the first control lever and the second control lever, respectively.

4. The remote control apparatus of claim 1, wherein the electronic control unit is configured to permit correction values to be entered into the storage device to correct variations in mechanical performance of the first and second control levers.

5. The remote control apparatus of claim 1, further comprising a contact member including an electric wire including a first connector and a second connector, wherein the contact member is arranged to output the signal to indicate that the lever learning mode is in the enabled state.

6. The remote control apparatus of claim 5, wherein the first connector comprises a male connector and the second connector comprises a female connector.

7. The remote control apparatus of claim 5, wherein the contact member is in the enabled state when the first connector and the second connector are connected to define a closed circuit.

8. The remote control apparatus of claim 5, further comprising a main switch disposed on the body of the remote control apparatus, wherein the contact member is in the enabled state when the first connector and the second connector are connected to define a closed circuit and the main switch is in an on position.

9. The remote control apparatus of claim 1, further comprising an indication light disposed on the upper surface of the body of the remote control apparatus, wherein the indication light illuminates when the lever learning mode is the enabled state.

10. The remote control apparatus of claim 9, wherein the indication light flashes one or more times to indicate a position of the first control lever or the second control lever.

11. The remote control apparatus of claim 1, wherein the remote control apparatus is calibrated before the remote control apparatus is installed on the boat including the more than one propulsion unit.

12. A boat including more than one propulsion unit and a hull, more than one outboard motor connected to the hull, a seat configured to accommodate at least one operator of the boat, a remote control system arranged to control outputs from the more than one propulsion unit, and a remote control apparatus in communication with the remote control system, the remote control apparatus comprising:

a body having a first side, a second side, and an upper surface, a first control lever including a first lever position sensor disposed on the first side of the body and a second control lever including a second lever position sensor disposed on the second side of the body, an electronic control unit disposed at least in part within the body of the remote control apparatus, the electronic control unit including a storage device configured to store a correction value to calibrate the first and second control levers and the first and second lever position sensors of the remote control apparatus, the electronic control unit configured to permit correction values to be entered into the storage device when a lever learning mode is in an enabled state, wherein the electronic control unit is configured to detect a state of a signal to determine whether the lever learning mode is in the enabled state to calibrate the first and second control levers and the first and second lever position sensors.

13. The boat of claim 12, wherein the boat comprises two propulsion units.

14. The boat of claim 12, wherein the boat comprises a first propulsion unit including a first outboard motor and a second propulsion unit including a second outboard motor.

15. The boat of claim 12, wherein the remote control apparatus is disposed proximate to the seat.

16. A method for storing a calibration value for a control lever in a remote control apparatus of a boat, the method comprising the steps of:

providing a remote control apparatus including a control lever and a storage device, outputting a signal indicating that a lever learning mode is enabled, positioning the control lever in a first position when the lever learning mode is enabled, and activating an actuator, wherein activating the actuator when the lever learning mode is enabled and the control lever is in the first position prompts storage of a value in the storage device to indicate the calibration value when the control lever is in the first position.

17. The method of claim 16, further comprising the step of:

mechanically engaging a contact member to interlock a first connector and a second connector to enable the lever learning mode.

18. The method of claim 16, further comprising the step of:

mechanically disengaging a contact member after performing the step of storing a value in the storage device to disable the lever learning mode.

19. The method of claim 16, further comprising the steps of:

positioning the control lever in a second position when a contact member is engaged to enable the lever learning mode; and activating the actuator to prompt storage of a second value corresponding to the second position of the control lever.

20. The method of claim 19, further comprising the steps of:

positioning the control lever in a third position when the contact member is engaged, and activating the actuator to prompt storage of a third value corresponding to the third position of the control lever.

21. The method of claim 20, wherein the first position of the control lever includes a full throttle position, the second position includes a shift transition position, and the third position includes a neutral position.

* * * * *